United States Patent [19]

Santic

[11] 3,976,191

[45] Aug. 24, 1976

[54] TRAY-TYPE ELEVATOR CONVEYOR

[75] Inventor: Blaz Santic, Burgau, Germany

[73] Assignee: Karl Mengele & Sohne, Gunzburg (Danube), Germany

[22] Filed: May 24, 1974

[21] Appl. No.: 473,185

[30] Foreign Application Priority Data

May 26, 1973 Germany ..... 2327077

[52] U.S. Cl. ..... 198/154; 198/158

[51] Int. Cl.[2] ..... B65G 17/16

[58] Field of Search ..... 198/154, 158, 140, 148, 198/163, 145, 1, 147, 149, 150, 151, 157; 211/121; 312/223, 268

[56] References Cited

UNITED STATES PATENTS

| | | | |
|---|---|---|---|
| 1,388,200 | 8/1921 | Price | 198/157 |
| 1,461,638 | 7/1923 | Wells et al. | 198/154 X |
| 3,278,052 | 10/1966 | Lichti | 198/158 X |
| 3,321,260 | 5/1967 | Anders | 198/158 X |
| 3,363,958 | 1/1968 | Antram | 198/158 X |
| 3,547,281 | 12/1970 | Lichti | 198/154 |

*Primary Examiner*—Albert J. Makay
*Assistant Examiner*—James M. Slattery
*Attorney, Agent, or Firm*—Toren, McGeady and Stanger

[57] ABSTRACT

A tray-type elevator conveyor for conveying a rack or load carrier is provided with an endless conveyor chain, an outer pair of straddle levers for pivotally suspending the load carrier, and an inner pair of straddle levers pivotally connected to the conveyor chain at one end and to the outer straddle levers at the other end. The length and number of inner straddle levers are variable for accommodating different paths of travel around the curved portion of the conveyor and for supporting different sizes of load carriers. By using the inner straddle levers to connect the chain and outer straddle levers, the path around the curved portion of travel on the chain can approximate a portion of a circle.

9 Claims, 4 Drawing Figures

TRAY-TYPE ELEVATOR CONVEYOR

BACKGROUND OF THE INVENTION

The present invention relates to a tray-type elevator conveyor and, more particularly, a tray-type elevator conveyor for a rack or cabinet with paternoster-type load carriers which are suspended from radially outward projecting joints of straddle levers and passed over rotating bodies by means of at least one endless chain or the like, the straddle levers being so dimensioned with respect to the rotating bodies as to adjust the distance between the suspension points and the chain so that this distance will be smaller on the end rounding portions than it is on the straight runs.

It is the object of this invention to provide a tray-type elevator conveyor wherein the speed difference between the straight runs and the curved portions of the orbital path is reduced and which affords an optimum utilization of the available space combined with a free choice and spacing of the load carriers, initially as well as subsequently.

Generally, the load carriers are so guided on their orbital path by means of carrying arms projecting from the chain as to permit a relatively close succession on the straight run and avoid obstruction of the circulating motion when rounding the conveyor ends on the curved portions of the path. This is accomplished at the expense of unnecessarily large clearances on the curved portions of the orbital path. Furthermore, the traveling speed in the direction of conveyance is suddenly increased or reduced at the start and termination of the end rounding motion.

The resulting nonsteady movements may cause undesirable oscillations of the load carriers. To avoid this, it has been suggested heretofore — in West German Utility Pat. No. 1,866,533 — to use carrying arms in the form of straddle levers consisting essentially of individual levers which are pivoted on the chain and provided with a central joint whose pivot also serves as supporting pivot for suspending the load carriers. A further requirement is that the length of the unequally long individual levers be approximately equal to the diameter of the rotating rollers and that the individual levers of each carrying arm be spaced apart by a distance corresponding to about half the circumference of the deflector rollers. What is achieved thereby is that the distance between the suspension points of successive load carriers is smaller on the curved portion of the orbital path than it is on the straight run so that owing to the reduced length of the carrying arm during the end rounding movement the mass acceleration forces are lower than they would be with a carrying arm of unchanging length.

While the suspension points on fixed carrying arms describe a circular arc during the end rounding movement, i.e. when they are transferred from the ascending to the descending run or vice versa, the curved portions of the path obtained with variable carrying arms of the type described have the form of a pointed parabola with non-steady speeds on the end rounding portion of the path which, although reduced as compared with those caused by movement along a circular arc (with fixed carrying arms), still feature very high levels of normal and tangential inertia forces.

This has a particularly adverse effect during starting and braking. The result is increased wear and the need for comparatively elaborate and expensive drive means. Furthermore, severe limitations are imposed upon the traveling speed of the load carriers on the straight runs inasmuch as the system tends to oscillate on the curved portions of the path and, moreover, the load may easily slip out of the load carriers during starting and braking.

For all these reasons, the traveling speed is limited. However, this limitation is irreconcilable with the requirement that tray-type elevator conveyors should afford quick access and, consequently, move the load carriers at maximum possible speed.

Furthermore, the known tray-type elevator conveyors do not permit the simultaneous use of load carriers of different sizes or weights without a substantial loss of space, nor can the spacing and/or dimensions of the load carriers be changed subsequently without a loss of space, especially in the case of tray-type elevators with stabilizing guide means.

SUMMARY OF THE INVENTION

In principle, the object of the present invention is accomplished by using carrying arms of variable length consisting of straddle levers characterized in that the two ends of the straddle levers carrying the load carriers are, in turn, pivoted on joints of one inner straddle lever each provided on the chain or on joints of further interposed straddle levers.

With the carrying arms designed in accordance with the present invention, the curved portions of the orbital path form a parabola approaching the form of a circular arc, representing an ideal, almost steady transition for the reversal of the direction of movement of tray-type elevator conveyors in general. This arrangement has, above all, the advantage of reducing the centrifugal forces, with the result that the reduced inertia effect of the load carriers also facilitates the arrangement of the overall system and permits the traveling speed to be increased. The wear, too, will be correspondingly lower.

To permit the use of load carriers of different sizes in the same orbital path, a development of the invention provides for a further subdivision, such that between pairs of adjacent straddle lever carrying arms a further straddle lever carrying arm may be inserted on the central joints of the arms.

The advantageous parabolic form also reduces the height required by the tray-type elevator conveyor, which is a particular advantage if the suspension points of one load carrier each and its chains are to be shifted diagonally, vertically or in space to prevent oscillations without using additional guide means.

Such a combination is, therefore, a particularly advantageous development of the invention.

Thus, load carriers of different size and different weights can be advantageously combined with each other at the same chain spacing on the straight runs with the aid of differently dimensioned carrying arms and correspondingly different end rounding paths. In this manner, it is, for instance, possible to pass heavier load carriers at lower, lighter at higher speeds around the conveyor ends without risking oscillations and with approximately equal loads acting on the chains.

This and any other operating characteristic and, thus, a variation of the dimensional relations (size, weight and spacing of load carriers) is also achieved with load carriers moving on an orbital path defined by stabilizing means through an appropriate choice of the relationship between the lengths and/or angles of the individual levers or the number of straddle lever combinations grouped together to form a carrying arm.

Thus, the tray-type elevator conveyor in accordance with the invention combines light weight with maximum performance and adaptability.

The invention will now be described and explained in more detail with reference to a number of embodiments illustrated by way of example in the accompanying drawing, wherein

Figure 1:
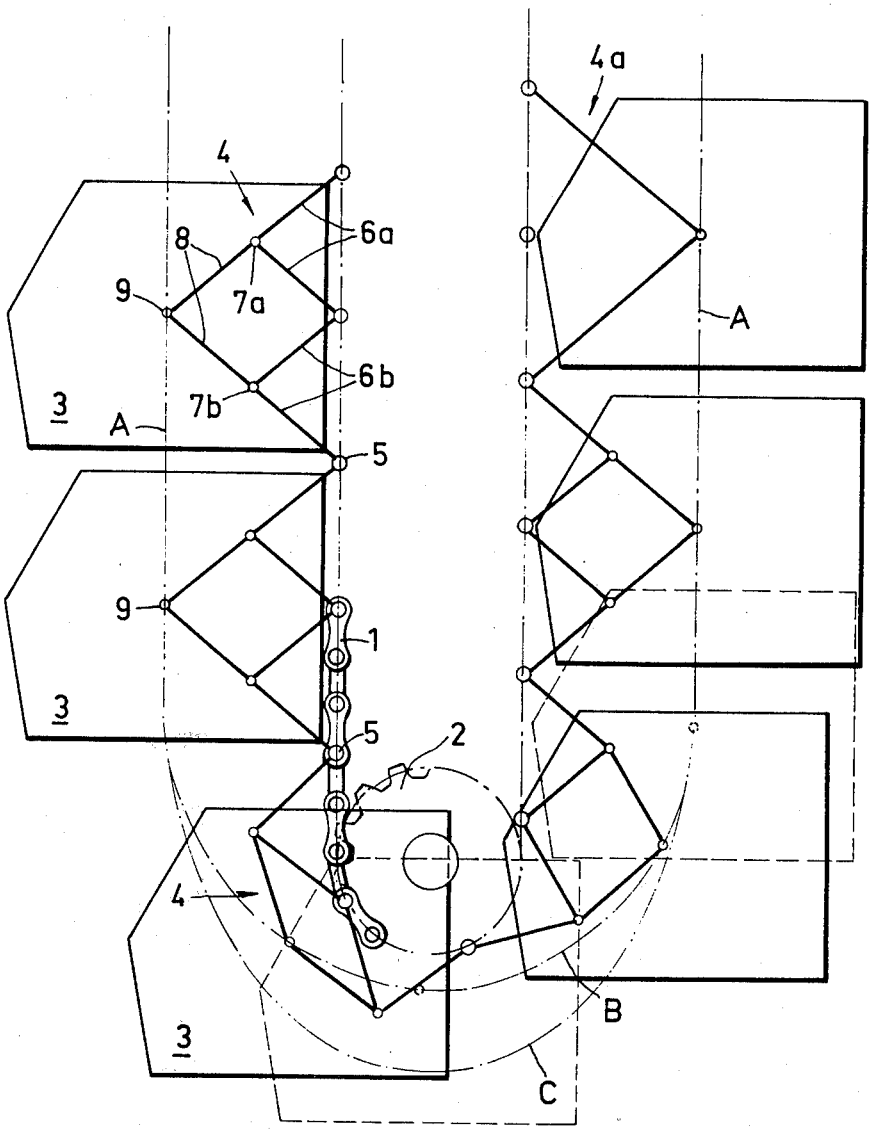
FIG. 1 shows a tray-type elevator conveyor embodying the principle of the invention.

The drawing shows the lower part of a tray-type elevator conveyor with an endless chain 1, a sprocket 2 and a load carrier 3. The carrying arms for the load carriers consist of straddle levers 4 supported on chain joints 5.

The straddle lever systems 4 in accordance with the invention comprise inner straddle levers 6*a* and 6*b* mounted on the chain and further straddle levers 8 pivoted to the central joints 7*a* and 7*b* of levers 6*a* and 6*b*. The pivots (not shown) of the central joints 9 simultaneously serve as pivots for the load carriers 3.

Figure 2:
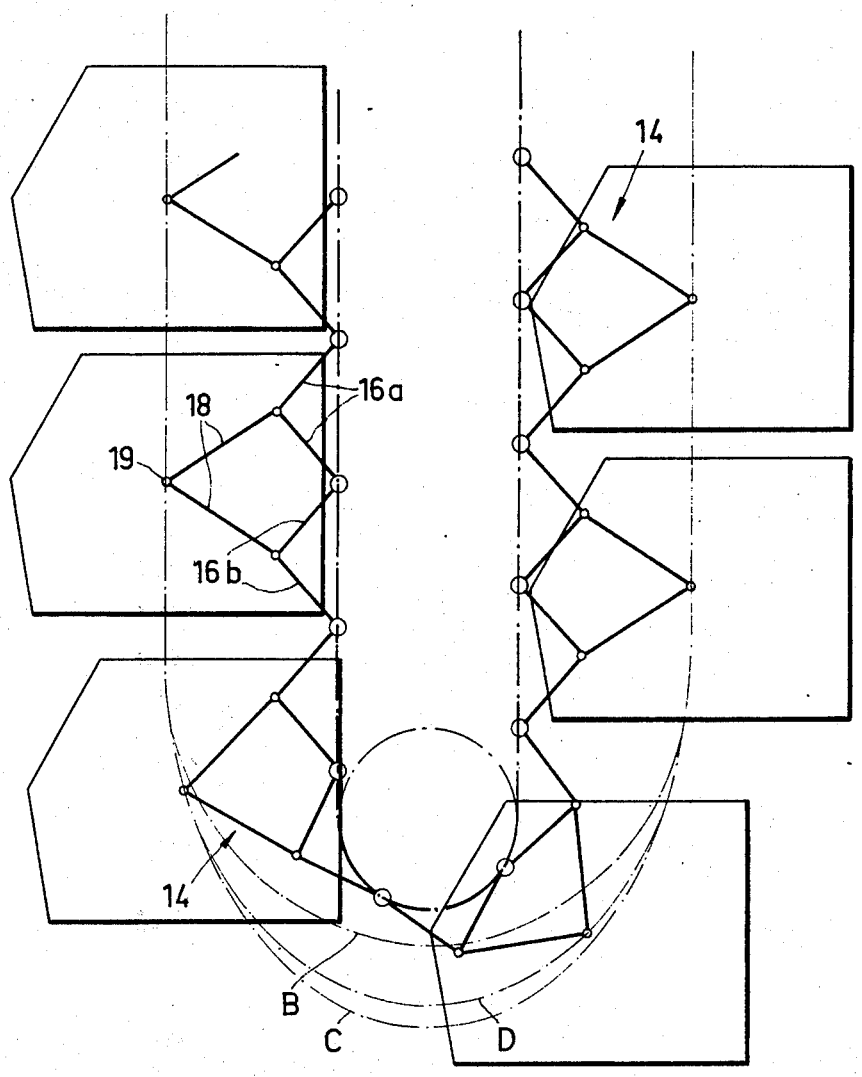
FIG. 2 a modification of the principle of the invention illustrated in FIG. 1.

With the tray-type elevator conveyor of the invention, the suspension points at the central pivots 9 describe an endless orbital path comprising the straight runs A and the lower as well as upper (not shown) conveyor end rounding paths B. The conventional straddle lever arrangement 4*a*, whose end rounding path bears the designation C, is shown in the top right part of the drawing. It will be noted that the orbital path B of the straddle lever carrying arms 4 in accordance with the invention is substantially circular while the end rounding path C has a more strongly curved parabolic form. Consequently, the speeds in the middle of the end rounding path B, for example, are substantially lower than those of the end rounding path C. The speed difference is about 30%, resulting in a corresponding reduction of inertia forces by about 50%. While the straddle levers 6*a* and 6*b* as well as 8 in FIG. 1 have equal lengths, a tray-type elevator with unequally long straddle lever carrying arms 14 is shown in FIG. 2, where the individual arms of the inner straddle levers 16*a* and 16*b* are shorter than the individual arms of the outer straddle levers 18. The orbital path D described by the pivots 19 assumes an intermediate position between the orbital paths B and C. It is obvious that different end rounding paths and characteristics can be adjusted through an appropriate choice of the relations between the individual lever arms.

Figure 3:
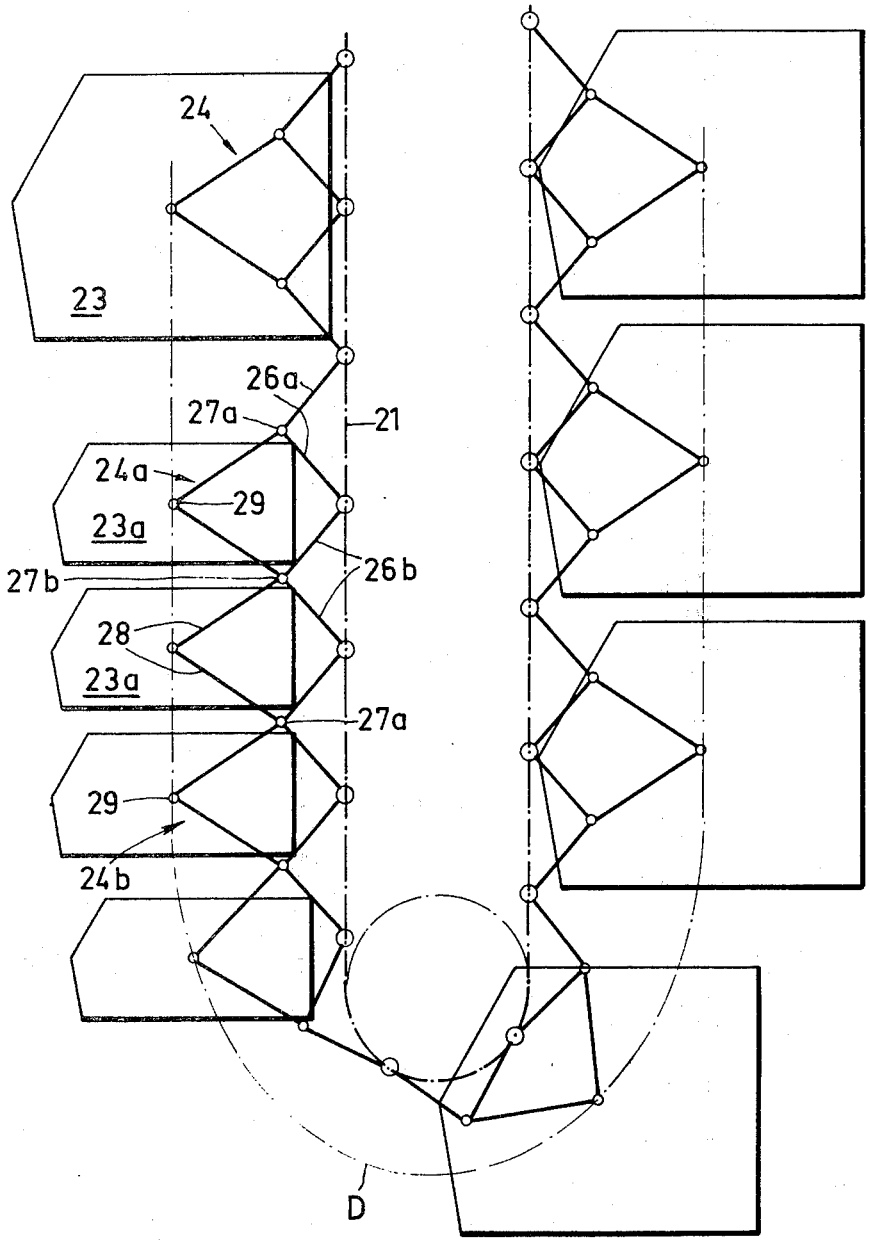
FIG. 3 a development of the principle of the invention illustrated in FIGS. 1 and 2.

FIG. 3 shows a development of a tray-type elevator conveyor in accordance with the invention wherein further straddle levers 28 are inserted at the central joints 27*a* and 27*b* of two adjacent straddle lever systems 24*a* and 24*b* with smaller load carriers of reduced height being suspended from the outer joints 29 of further straddle levers 28. It will be noted that the outer straddle levers 28 are spaced wider apart on those portions of the chain 21 where the large load carriers 23 are suspended. In spite of the difference in height and depth of the load carriers 23 and 23*a*, the suspension points 29 describe the same end rounding path D. This fact permits any standard elevator to be subsequently supplemented by further carrying arms and load carriers of small size, as illustrated in the drawing, while maintaining the basic spacing, of the inner straddle levers 26*a* and 26*b*.

Figure 4:
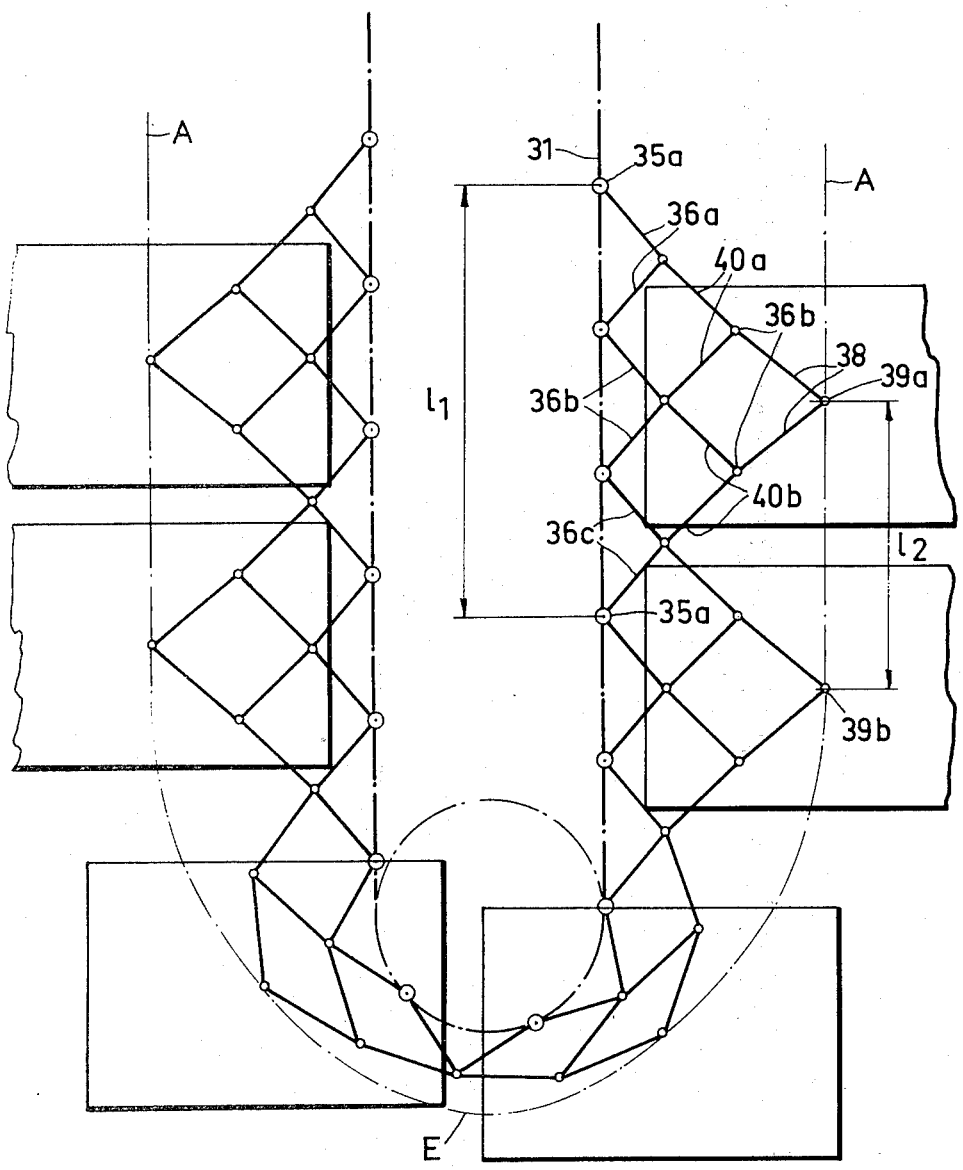
FIG. 4 a further development of the principle of the invention.

In accordance with the embodiment of the invention shown in FIG. 4, an optimum end rounding path E is achieved by inserting central straddle levers 40*a* and 40*b* between the outer straddle levers 38 and the inner straddle levers 36*a* and 36*b*, pivoted on the chain 31, and additional straddle levers 36*c*. In this arrangement, the spacing between the two outer chain joints 35*a* and 35*a* of a straddle lever system $l_1$ is greater than the spacing $l_2$ between two suspension points 39*a* and 39*b* of two adjacent straddle lever systems.

As a result, the end rounding path E is shifted further inward on the straight run A. The end rounding movement is initiated earlier so that a steady transition of the load carrier speeds from the straight run A to the end rounding path E and vice versa is ensured. The acceleration is reduced accordingly and the vibrations induced in this carrier system are substantially lower than even those induced in the systems described hereinbefore.

Moreover, the present embodiment of the invention affords a substantially higher number of possible combinations in accordance with the developments described hereinbefore.

A practical arrangement of the straddle levers in accordance with the invention is one in which the number of inner straddle levers is twice that of the outer straddle levers, thus lending greater stability to the straddle lever system.

Owing to the properties as described herein above, the tray-type elevator conveyors in accordance with the present invention require less elaborate and less expensive structures and drives, have a longer useful life and/or permit the traveling speed to be increased, if desired.

Further advantages include a better distribution of the inertia forces and adaptation to individual requirements as well as the possibility of converting the carrying and stabilizing systems as desired.

What is claimed is:

1. A tray-type elevator conveyor and, more particularly, a tray-type conveyor for a rack or cabinet with load carriers, comprising at least one endless chain for conveying the load carriers along a straight and a curved portion of travel, a plurality of outer pairs of outer straddle levers projecting outwardly from said at least one endless chain for carrying said load carriers, each outer straddle lever having a first end and a second end, a plurality of central pivots, each of said plurality of central pivots pivotally connecting the first ends of the outer straddle levers in one outer pair of outer straddle levers and pivotally connecting said first ends with a portion of one load carrier to form a suspension point therefor, and a plurality of inner pairs of inner straddle levers projecting outwardly from said at least one endless chain and interposed between said at least one endless chain and said plurality of outer pairs of outer straddle levers, each pair of said plurality of inner pairs of inner straddle levers comprising a first inner straddle lever having a first end pivotally connected to said second end of one of said outer straddle levers of said pairs of outer straddle levers and a second end pivotally connected to said at least one endless chain, and a second inner straddle lever having a first end pivotally connected to said first end of said first inner straddle lever and to said second end of said one of said outer straddle levers of said pairs of outer straddle levers, and a second end pivotally connected to said at least one endless chain, said second end of said first inner straddle lever being spaced from said second end of said second inner straddle lever along said at least one endless chain, so that the speed of the carrier in the curved portion of travel is substantially the same as the speed of carriers in the straight portion of travel.

2. The device according to claim 1, wherein the suspension points are shiftable diagonally, vertically, and in space on the load carriers between pairs of correspondingly shifted chains.

3. The device according to claim 2, wherein each of said suspension points are equally spaced from said chain on the straight portion of the conveyor and capable of being differently spaced from the curved portion of the conveyor, whereby load carriers of different size and weight may be supported and conveyed.

4. The device according to claim 1, wherein the length of each of said inner straddle levers is equal to the length of each of said outer straddle levers.

5. The device according to claim 1, wherein the length of each of said inner straddle levers is shorter than the length of each of said outer straddle levers.

6. The device according to claim 1, wherein said second end of said first inner straddle lever pivotally connected to said at least one endless chain is also pivotally connected to the second end of the first inner straddle lever of another said inner pair of inner straddle levers.

7. The device according to claim 6, wherein said second end of said second inner straddle lever pivotally connected to said at least one endless chain is also pivotally connected to the second end of the second inner straddle lever of another said inner pair of inner straddle levers, the first ends of the two second inner straddle levers being pivotally connected to separate ones of outer straddle levers of one said outer pair of outer straddle levers.

8. The device according to claim 7, wherein the pivot point of said second end of said second inner straddle lever is positioned equidistant the second ends of said outer straddle levers of a pair of outer straddle levers to which said second inner straddle lever is connected.

9. A tray-type elevator conveyor and, more particularly, a tray-type conveyor for a rack or cabinet with load carriers, comprising at least one endless chain for conveying the load carriers along a straight and a curved portion of travel, a plurality of outer pairs of outer straddle levers projecting outwardly from said at least one endless chain for carrying said load carriers, a plurality of central pivots, each central pivot pivotally connecting one end of one outer straddle lever of one said pair with one end of the other outer straddle lever of the pair, each central pivot also pivotally connected to one load carrier, and a plurality of inner sets of inner straddle levers, each of said inner sets of inner straddle levers comprising a first set of levers having one end pivotally connected to the other ends of one of said plurality of outer pairs of outer straddle levers, and a second set of levers having one end pivotally connected to said at least one endless chain and the other end pivotally connected to the other end of said first set of levers, so that the speed of the load carrier in the curved portion of travel is substantially the same as the speed of the load carrier in the straight portion of travel.

* * * * *